United States Patent [19]

Breslow

[11] 4,071,247

[45] Jan. 31, 1978

[54] CARD GAME

[75] Inventor: Jeffrey D. Breslow, Highland Park, Ill.

[73] Assignee: Marvin Glass & Associates, Chicago, Ill.

[21] Appl. No.: 762,408

[22] Filed: Jan. 26, 1977

[51] Int. Cl.[2] ..... A63F 1/00

[52] U.S. Cl. ..... 273/308

[58] Field of Search ..... 273/152 R, 152.4, 152.41, 273/152.42, 152.43, 152.44, 152.6

[56] References Cited

U.S. PATENT DOCUMENTS

| | | | |
|---|---|---|---|
| 744,502 | 11/1903 | Delamere | 273/152.4 |
| 1,277,969 | 9/1918 | McDowell | 273/152.42 |
| 1,357,166 | 10/1920 | Hart | 273/152.4 UX |

*Primary Examiner*—Anton O. Oechsle

*Attorney, Agent, or Firm*—Mason, Kolehmainen, Rathburn & Wyss

[57] ABSTRACT

An amusement card game for two or more players comprises a deck of cards each having a playing face and a decorative back surface and the deck includes a set of flag cards with the playing face of each card having a flag for a particular country of the world depicted thereon. For each flag card there is provided a set of general cards, each card having a playing face with a picture of a general of the armed forces of the respective country, in uniform, and a number indicating the order to rank of the general in the respective set. At least one stop card is provided with the playing face indicating that the round of play of trick should begin after a particular number of flag cards have been played in rotation. The order of placement or play of the flag cards represents and determines the strength or trump of the respective nations represented thereby. After dealing of hands to the players and determination of the order or trump of the flag cards, rounds of play are commenced wherein each player plays a general card and the card of the highest order nation that is played wins the trick. When two or more cards of the same highest order nation are played in a trick, the player having the general card with the highest number thereon is the winner of the trick. The game is continued until one of the players wins a selected number of tricks and more than one hand may be required before reaching this objective.

7 Claims, 2 Drawing Figures

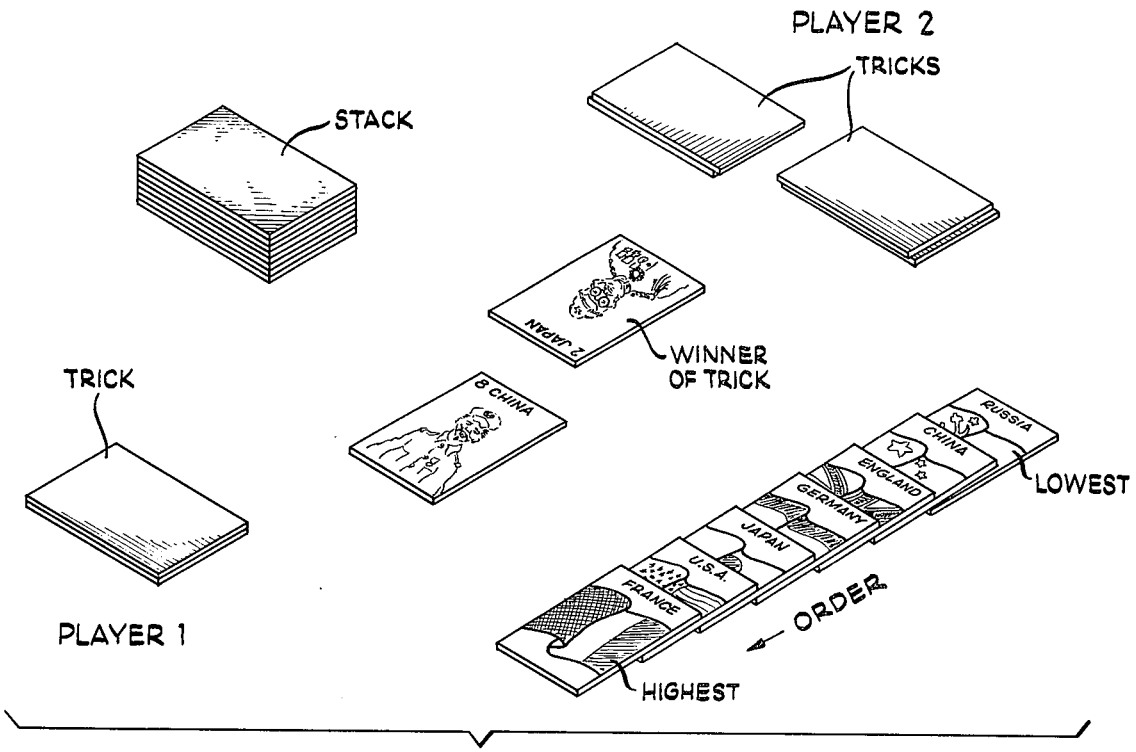
Fig 1
Fig 2
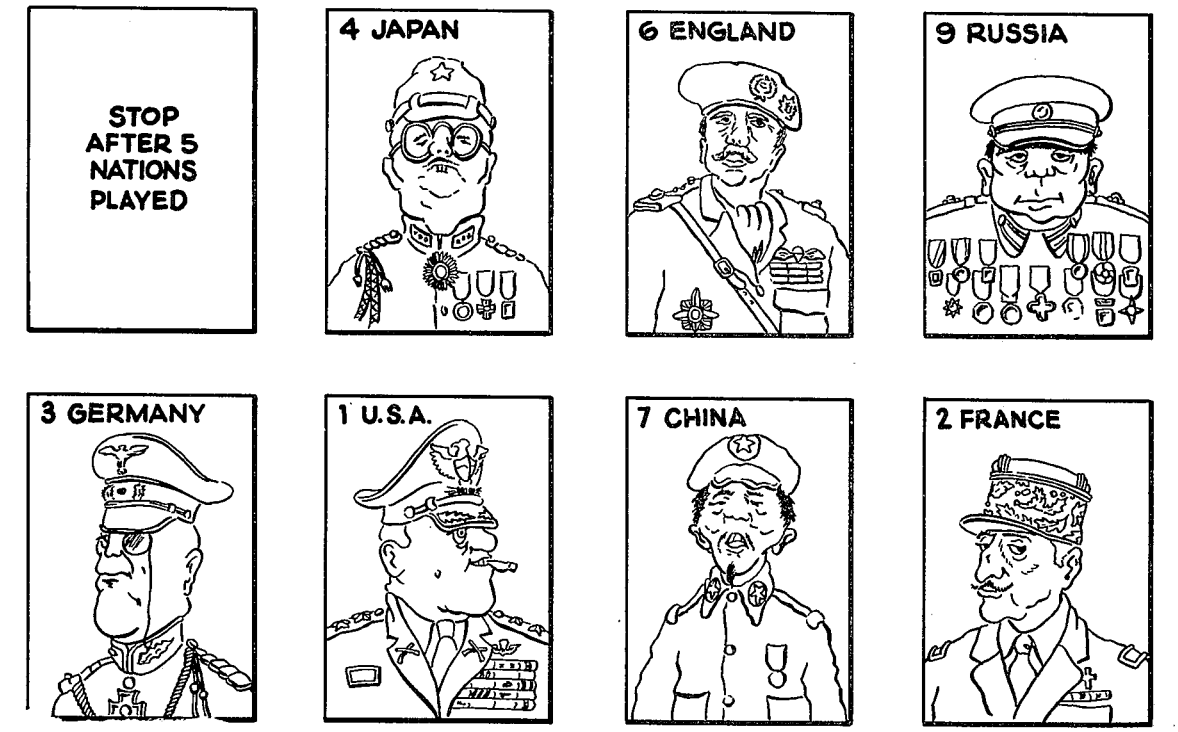

CARD GAME

BACKGROUND OF THE INVENTION

1. Field of the Invention

The present invention relates to an amusement card game for two or more players and more particularly relates to an amusement card game of a semi-political nature wherein a set of flag cards, each representing a particular country of the world is provided and the order of placement or play of the flag cards determines the relative strength or trump order of the nations represented thereby. A set of general's cards is provided for each of the nations of a flag card and the general cards in each set are numbered to provide an order of relative strength.

2. Description of the Prior Art

Amusement card games such as contract bridge and the like, using a standard deck of 52 playing cards are popular and in a bridge game, four hands are dealt out utilizing the entire deck. Each player bids in rotation based on the strength of his hand and trys to indicate to his partner his strengths and establish a trump suit which represents the strongest suit in the combined hands. The successful bidder determines the trump suit and the players hands are then played in rotation or tricks with the trump cards having a higher order and winning the tricks over those cards of a non-trump suit. So far as is known, a card game wherein particular countries are designated to represent an order of strength or trump has not been developed.

SUMMARY OF THE INVENTION

The present invention comprises an amusement playing card game for two of more players including a deck of playing cards, each card having playing indicia on a playing face and non-playing decorative design on an opposite surface. The deck comprises a plurality of flag cards, each card having indicia on the playing face depicting the flag of a particular one of a plurality of different countries of the world. For each flag card, there is provided a set of general cards with each card in the set having indicia on the playing face having a picture of a general officer of the armed forces of the respective country, in uniform. In addition, each general card in each set includes a number indicating the order of rank of the general in the set. The deck also includes at least one stop card having indicia on the playing face, calling for the stoppage of the procedure of discarding and selection of additional cards from a stack of cards after a particular number, such as five of six flag cards have been played.

Initially, the players are dealt a hand with the number of cards in the hands equaling the number of general cards in each set. In rotation, each player places face up on a playing surface, one of the cards from his hand and then picks another card from a face down stack of remaining cards which remain after the hands are dealt out to the players. This rotational play continues until all or a selected number of flag cards have been placed face up on the playing surface. A stop card may be played to effect the selected number of rounds and stop the play at that number. The order in which the players play the flag cards from their hands determines the order strength or trump of the flag cards in the following portion of the game. After the rotation and order placement of the flag cards has been completed, each player in rotation plays a general card from his hand and when all of the players have played a general card in the round, a trick winner is determined based on who plays a general's card of the higher order country as previously determined. When two or more general's cards of the same highest order flag card are played in a trick, the general's card carrying the highest number thereon wins the trick. Continuing rounds or tricks are played until a winner is developed by a player winning a required number of tricks. Should all the cards in the player's hands have been played without a winner being obtained, the deck will be reshuffled and the game will be continued as before until one player wins.

BRIEF DESCRIPTION OF THE DRAWINGS

In accordance with the present invention, reference should be hand to the following detailed drawings for a better understanding of the amusement card game.

FIG. 1 represents diagrammatically and in perspective, a game situation with a playing surface on which some of the cards of the deck of cards in accordance with the present invention have been played. The cards remaining in each player's hand are not shown; and FIG. 2 is a view of the playing faces of a stop card and the general's cards of the various nations, flag cards of which are illustrated in face up position after playing in order on the playing surface in FIG. 1, to determine trump or nation strength.

DESCRIPTION OF THE PREFERRED EMBODIMENT

Referring now more particularly to the drawings, an amusement card game adapted for play by two or more players is illustrated and includes a deck of playing cards, each card having a playing face as best shown in FIG. 2 and a decorative back surface as shown in FIG. 1 in the customary manner. The deck of cards includes a first set of flag or nation cards as shown in FIG. 1, and each of the flag cards of the set has imprinted on its playing face, a picture of the flag and the written name of a country of the world. In the example of FIG. 1, seven flag cards are provided and include Russia, China, England, Germany, Japan, U.S.A, and France. For each of these flags or nations there is provided a set of general cards and each general card in a set includes on its playing face a picture of a general of the armed forces of the respective country, in uniform together with a printed name of the country. In addition, the playing face of each general card includes a number and the numbers in each set indicate the order to rank of the respective general cards in the set. As shown in FIG. 2, the generals and their uniforms closely resemble the true appearance of a general officer of the armed forces of the particular countries. As an example, each set of general cards may include nine cards with the numbers thereon ranging from one to nine.

In addition to the set of flag or nation cards as described and the individual set of ordered general cards for each flag of nation represented, the deck of cards includes one or more stop cards bearing the written notation on its playing face "stop after five nations played". Two stop cards are usually provided in a deck and the number for each card is usually different so that one card requires play stoppage after five nations have been played, for example, and the other stop card indicating that play should stop after six nation cards have been played. A typical deck of cards in accordance with the present invention thus may include seven nation or flag cards as depicted, and a set of nine general's cards for each nation along with two stop cards and this deck would then have a total of 72 cards.

The amusement card game of the present invention is played in the following manner: After shuffling the deck of cards, nine cards are dealt to each player in the game in rotation to comprise a players's hand. If two players are present, 18 cards are dealt and the remaining 52 cards are then placed face down on the playing surface in a stack as illustrated in FIG. 1. Each player's hand as dealt, includes a number of cards equal to the number of general cards in each set, and with a 72 card deck as described, a maximum of seven players can play the game in order to leave a stack after all of the hands are dealt to each player.

After the hands are dealt out in the usual rotation, a first player discards one of the cards in his hand and picks a new card from the stack. In this process the players are attempting to acquire a group of general cards under each one or more of their flag cards with the numbers of the general cards having high ranking. During this rotation process, a player may play a flag card by placing the card face up on the playing surface. The order in which the flag cards are thus played determines the order of strength or trump of the flag card nations as shown. For example, if a player has in his hand, a flag card of a particular nation, for example Russia, and three or four Russian general cards having high order numbers such as six, seven, eight and nine, he may want to play the Russian flag card as soon as possible to best ensure a high order ranking for that flag so that his Russian general cards will most likely be able to win some tricks. In the event a player in his hand has many low numbered general cards and not many cards of the same nations, he would try to improve the strength of his hand by picking new cards from the stack and discarding the lower numbered general cards. Should a player have one of the stop cards in his hand, after the required number of flag cards have been played the player may play the stop card to discontinue the selection of new cards from the stack and the discarding action. When all the flag cards are played or a stop card is played the players begin playing the remaining cards in their hands in rotation and try to win the most tricks. For each round of play or trick, each player must play a general card and must follow the suit or nation of any previous card played in the round if he has a card of each nation in his hand. A general card from the highest order ranking nation will win the trick and when two or more players during one round of play, play general cards of the same nation, the general card having the highest number thereon wins the trick provided that no general card of a nation of higher order is played.

In the initial ordering sequence of play of the flag or nation cards, the first flag card placed on the playing surface may be designated as the highest rank in the order and subsequent play of the flag cards generates the order of ranking down from the top. These cards may be displayed in the ordered row as shown in FIG. 1 and the later played and ranked flag cards are slipped under the previously played cards with the name of the country on the card positioned to be clearly visible so that nation or flag order can be readily determined by a player at a glance.

In another mode of play, the flag cards may be placed on top of one another and the first played flag card may be designated to have the lowest ranking or trump in the order. Later played cards would then have a higher order ranking.

The winner of the game is designated by requiring a player to win a particular number of tricks, such as five or six. In the event that the cards are all played and no player has won the required number of tricks, the cards are picked up and reshuffled and the playing sequence as described, is repeated until one player wins the required number of tricks.

From the foregoing it will be seen that the amusement card game of the invention has a political theme and is of interest to children as well as adults. The game requires strategy and thought in determining which cards to play and how to build a powerful hand during the drawing procedure from the stack.

Although the present invention has been described with reference to a single illustrative embodiment thereof, it should be understood that numerous other modifications and embodiments can be developed by those skilled in the art that will fall within the spirit and scope of the principles of this invention.

What is claimed as new and desired to be secured by Letters Patent of the United States is:

1. A playing card game for two or more players comprising:

a deck of playing cards, each card having playing indicia on a playing face and a non-playing decorative design on an opposite surface, a plurality of flag cards, each with indicia on said playing face depicting the flag of a particular one of a plurality of different countries of the world, a set of general cards for each flag card, each general card in each set having indicia on said playing face having a picture of a general officer of the armed forces of the respective country in uniform, plus a number thereon indicating the order of rank of each general in the set of general cards, and at least one stop card having indicia on the playing face thereof calling for the stoppage of the procedure of discarding and selection of additional cards from a stack of said cards after a particular number of flag cards have been played, whereby, said players, having initially dealt to them as their respective hands, a number of cards equal to the number of general cards in each set, and in rotation each player placing face up on a playing surface a card from his hand and thereafter picking another card from a face down stack comprised of the remaining cards not dealt out to the players initially, said rotation continuing until all or a selected number of flag cards as designated by a stop card have been played, the order of face up placement of said flag cards from the players' hands determining the order of strength or trump of the flag cards, and subsequent to the placement of the flag cards each player in rotation playing a general card from his hand, a general card of the highest order flag card winning each trick which comprises a card of each player as played from his hand, and the number on general cards of the same flag card determining the winner of a trick when two or more general cards of the highest order flag card remaining to be played are played in a trick, a winner of the card game requiring the winning of a selected number of tricks by a player.

2. The playing card game of claim 1 wherein said deck of playing cards includes a set of said flag cards with each card in the set representing a major political country of the world.

3. The playing card game of claim 2 wherein flag cards are provided for Russia, China, Germany, France, Japan, England and the U.S.A.

4. The playing card game of claim 1 wherein each set of general cards includes nine cards numbered consecutively from one to nine.

5. The playing card game of claim 1 wherein one of said stop cards has printed on its playing face "stop after five nations played".

6. The playing card game of claim 5 wherein a second stop card is provided having "stop after six nations played" printed on its playing face.

7. The playing card game of claim 1 wherein flag cards are provided for Russia, China, Germany, France, Japan, England and the U.S.A., and wherein each set of general cards includes nine cards numbered consecutively from one to nine and including two stop cards bearing indicia "stop after five nations played" and "stop after six nations played", respectively.

* * * * *